US007607638B2

(12) United States Patent
Wilson et al.

(10) Patent No.: US 7,607,638 B2
(45) Date of Patent: Oct. 27, 2009

(54) EGR VALVE HAVING REST POSITION

(75) Inventors: Joseph A. Wilson, Royal Oak, MI (US); Michael J. Halsig, Warren, MI (US); John W. Duddles, Clarkston, MI (US); Hal E. Pringle, Bloomfield, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 11/885,381

(22) PCT Filed: Mar. 8, 2006

(86) PCT No.: PCT/US2006/008184

§ 371 (c)(1),
(2), (4) Date: Jun. 6, 2008

(87) PCT Pub. No.: WO2006/096750

PCT Pub. Date: Sep. 14, 2006

(65) Prior Publication Data

US 2008/0230040 A1 Sep. 25, 2008

Related U.S. Application Data

(60) Provisional application No. 60/659,478, filed on Mar. 8, 2005.

(51) Int. Cl.
*F16K 31/02* (2006.01)

(52) U.S. Cl. ..... 251/129.11; 123/568.21; 123/568.24

(58) Field of Classification Search ..... 251/129.11; 123/568.21, 568.23, 568.24
See application file for complete search history.

(56) References Cited

U.S. PATENT DOCUMENTS

| | | | |
|---|---|---|---|
| 245,662 | A | 8/1881 | Rinderknecht |
| 1,987,135 | A | 1/1935 | Sugden |
| 3,507,260 | A | 4/1970 | Walker |
| RE27,993 | E | 4/1974 | Walker |
| 4,408,627 | A | 10/1983 | Harris |
| 4,460,284 | A | 7/1984 | Lauterbach et al. |
| 4,612,880 | A | 9/1986 | Brass et al. |
| 4,649,703 | A | 3/1987 | Dettling et al. |
| 4,666,124 | A | 5/1987 | Giacobbi |
| 4,725,040 | A | 2/1988 | Fornuto |
| 5,089,237 | A | 2/1992 | Schuster et al. |
| 5,205,170 | A | 4/1993 | Blechinger et al. |
| 5,277,542 | A | 1/1994 | Nakanishi |
| 5,337,790 | A | 8/1994 | Heritier-Best et al. |

(Continued)

FOREIGN PATENT DOCUMENTS

| | | |
|---|---|---|
| CA | 2138577 | 6/1995 |

(Continued)

*Primary Examiner*—John K Fristoe, Jr.
(74) *Attorney, Agent, or Firm*—Warn Partners, P.C.

(57) ABSTRACT

During normal operation of diesel engines the EGR valve poppet often becomes stuck to the valve seat in the closed position, due to excessive build up of exhaust gas debris, which renders the valve inoperable. This usually occurs after the engine is shut down and the valve is seated. Features, which locate the valve poppet in an unseated position when not in use, are implemented into the EGR valve design to prevent this sticking from occurring, thereby increasing product robustness and prolonging product life.

17 Claims, 8 Drawing Sheets

U.S. PATENT DOCUMENTS 5,426,936 A 6/1995 Levendis et al.
5,443,241 A 8/1995 Odaira et al.
5,511,531 A 4/1996 Cook et al.
5,588,414 A 12/1996 Hrytzak et al.
5,593,132 A 1/1997 Hrytzak
5,607,010 A 3/1997 Schonfeld et al.
5,666,932 A 9/1997 Bauerle et al.
5,669,364 A 9/1997 Everingham
5,699,664 A 12/1997 LaFleur
5,704,585 A 1/1998 Hrytzak et al.
5,722,634 A 3/1998 Hrytzak et al.
5,771,873 A 6/1998 Potter et al.
5,785,030 A 7/1998 Paas
5,785,034 A 7/1998 Moedinger et al.
5,901,690 A 5/1999 Hussey et al.
5,911,401 A 6/1999 Hrytzak et al.
5,924,675 A 7/1999 Hussey et al.
5,947,092 A 9/1999 Hussey et al.
5,950,605 A 9/1999 Hussey et al.
5,956,947 A 9/1999 Tanaka et al.
5,957,116 A 9/1999 Haegele et al.
5,957,117 A 9/1999 Everingham
5,960,776 A 10/1999 Everingham et al.
5,979,866 A 11/1999 Baxter et al.
5,988,147 A 11/1999 Everingham
5,996,551 A 12/1999 Schroder
5,996,559 A 12/1999 Busato et al.
5,998,343 A 12/1999 Ishii
6,006,732 A 12/1999 Oleksiewicz
6,073,617 A 6/2000 Busato et al.
6,101,999 A 8/2000 Ohashi et al.
6,109,302 A 8/2000 Bircann
6,116,224 A 9/2000 Cook et al.
6,138,652 A 10/2000 Cook et al.
6,152,115 A 11/2000 Busato et al.
6,170,476 B1 1/2001 Cook et al.
6,189,520 B1 2/2001 Cook et al.
6,213,446 B1 * 4/2001 Dismon et al. ..... 251/76
6,213,447 B1 4/2001 Bircann et al.
6,217,001 B1 4/2001 Gluchowski et al.
6,223,733 B1 5/2001 Busato et al.
6,230,742 B1 5/2001 Bircann
6,247,461 B1 6/2001 Smith et al.
6,272,913 B1 8/2001 Naegele
6,295,975 B1 10/2001 Yew et al.
6,299,130 B1 10/2001 Yew et al.
6,311,677 B1 11/2001 Cook et al.
6,330,880 B1 12/2001 Okada et al.
6,357,429 B1 3/2002 Carnevale et al.
6,378,507 B1 4/2002 Gagnon
6,382,151 B2 5/2002 Pierik
6,390,078 B1 5/2002 Gee et al.
6,390,079 B1 5/2002 Gagnon et al.
6,397,798 B1 6/2002 Fiaccabrino
6,409,145 B1 6/2002 Fong et al.
6,415,777 B1 7/2002 Gagnon
6,418,892 B1 7/2002 Donce et al.
6,422,221 B2 7/2002 Pietrowski et al.
6,443,135 B1 * 9/2002 Dismon et al. ..... 123/568.18
6,453,934 B1 9/2002 Bircann et al.
6,481,424 B2 11/2002 Bircann et al.
6,644,622 B2 11/2003 Modien
6,655,657 B2 12/2003 Bircann
6,748,935 B2 6/2004 Brosseau et al.
6,758,196 B2 7/2004 Brosseau et al.
6,772,729 B2 8/2004 Brosseau et al.
6,776,146 B1 8/2004 Ricart-Ugaz et al.
6,823,854 B2 * 11/2004 Bellon ..... 123/568.23
6,874,754 B2 4/2005 Geib et al.
6,874,755 B2 4/2005 Bircann
2002/0023630 A1 2/2002 Balekai et al.
2002/0066427 A1 6/2002 McCoy et al.
2002/0179034 A1 12/2002 Sisken
2004/0041115 A1 3/2004 Geib et al.
2004/0051067 A1 3/2004 Fujita et al.
2004/0065860 A1 4/2004 Bircann
2004/0069285 A1 4/2004 Telep et al.
2004/0079347 A1 4/2004 Bender et al.
2004/0103888 A1 6/2004 Bellon

FOREIGN PATENT DOCUMENTS

DE 35 17 914 A1 11/1986
DE 198 25 583 12/1999
EP 0 588 706 3/1994
EP 1 201 907 5/2002
EP 0712998 3/2003
EP 1 420 158 5/2004
FR 2724976 3/1996
FR 2727158 5/1996
FR 2748780 11/1997
FR 2772429 6/1999
FR 2773847 7/1999
FR 2812684 2/2002
FR 2816660 5/2002
FR 2821645 9/2002
FR 2824380 11/2002
JP 62000603 1/1987
JP 8-232651 9/1996
WO WO 97/43538 11/1997
WO WO 99/31372 6/1999

* cited by examiner

EGR VALVE HAVING REST POSITION

This application is a National Stage of International Application No. PCT/2006/008184 filed on 8 Mar. 2006. This application claims the benefit of PCT/2006/008184 filed on 8 Mar. 2006 and U.S. Provisional Application No. 60/659,478, filed 8 Mar. 2005. The disclosures of the above applications are incorporated herein by reference.

FIELD OF THE INVENTION

The present invention relates to an arrangement for maintaining an EGR valve in the open position for an amount of time after the engine has stopped.

BACKGROUND OF THE INVENTION

Federal and State legislation require control of vehicle exhaust emissions. Oxides of Nitrogen (NOx) are one of the exhaust gas emissions that must be controlled. The higher the combustion temperature, the greater amount of NOx is produced. A system, referred to as the exhaust gas recirculation (EGR) system, has been developed to reduce combustion temperatures which thus reduces the amount of NOx emissions from the vehicle. A schematic of this system is shown in FIG. 1. In the EGR system, a portion of the exhaust gas from the engine's exhaust manifold is recirculated back to the intake manifold where the exhaust gas is combined with incoming fresh air. The mixture of exhaust gas and fresh air are then compressed and ignited in the cylinder. This results in a lower combustion temperature and a reduction in NOx that is emitted from a vehicle's exhaust system.

Referring to FIG. 1, an EGR system 10 comprises of an EGR valve 12 that controls the flow of exhaust gas to the intake manifold. Space Conduits 14, 16, 18 provide the interconnection between an exhaust manifold 20, the EGR valve 12, and an intake manifold 22. The system shown uses an electrically controlled EGR valve 12. Thus, an engine control unit (ECU) 24 provides a signal that controls the open and closing of the EGR valve. As the EGR valve 12 opens and closes, the flow rate of exhaust gas to the intake manifold increases and decreases respectfully. It is also typical to have a throttle valve 26 to control airflow into the intake manifold and an exhaust gas cooler 28 to reduce temperature of recirculated exhaust gas prior to being mixed with the fresh air.

The required EGR valve 12 flow rate of recirculating exhaust gas is dependent upon several factors that include, but are not limited to, the displacement of the engine, and the pressure differential between the exhaust system and the intake system. Operating force of the EGR system is also a factor used in the selection criteria for the type of actuator used for the EGR valve. Higher flow rates require larger valves with greater area and higher operating forces. Lower pressure differential between the exhaust and intake manifold requires larger valves to achieve the desired flow rate. Furthermore, debris in the exhaust gas accumulates on the valve components and causes the valve components to stick to one another or restricts movement if sufficient operating force is not available to move the valve components once the debris has stuck to the valve components.

During normal operation of diesel engines the EGR valve poppet often becomes stuck to a valve seat when the EGR valve poppet is in the closed position. This condition renders the EGR valve inoperable. This is caused by excessive build up of exhaust gas debris in the EGR valve. This typically occurs after the engine is shut down and the EGR valve is in the closed position or the EGR valve poppet is seated on the valve seat. For example, EGR systems that run with cooled exhaust tend to produce a moist vapor like (lacquer) contamination, until the engine warms up, which builds up on the valve poppet and valve seat as exhaust gas flows past them as described in the previous paragraphs. Moreover, the lacquer contamination combines with a powdery (soot) type of contamination that is present in the exhaust gas at elevated (greater than 160° C.) exhaust gas temperatures. When the valve is commanded to the closed position the lacquer, soot, or a combination of the two, cures or hardens when the engine is shut off and causes a "bond" between the valve seat and poppet. This often happens after then engine is shut down for a duration of time such as 20 minutes or greater. When the engine is started again and the EGR valve is commanded to open, and the "bond" that has occurred prevents the valve from opening when there is insufficient force and or torque available from the EGR valve to overcome the bonded sticking force.

Therefore it is desirable to develop an EGR valve, wherein the EGR valve poppet is not seated on the EGR valve seat when the engine is shut down. Thus, the EGR valve design prevents the EGR poppet valve from sticking to the valve seat, thereby increasing product robustness and prolonging product life. The following paragraphs and figures describe the application and use of an EGR valve with features that locate the poppet in a resting position when the valve is not in use so that at least a portion of the poppet valve is not contacting the valve seat.

SUMMARY OF THE INVENTION

The present invention is directed to a mechanism for preventing a poppet valve in an exhaust gas recirculation (EGR) valve assembly in a motor vehicle from sticking to a valve seat resulting in the EGR valve being inoperable. The EGR valve assembly includes an EGR valve body having an inlet port and an outlet port with the valve body defining a pass through for fluid flow between the inlet port and the outlet port. A valve seat is disposed between the inlet port and outlet port and has an aperture positioned in the path of fluid flow. A valve stem is positioned in the valve body and has a poppet valve member disposed on the end of the valve stem. The valve stem is configured to slide axially along its longitudinal axis to bring the poppet valve in contact with the valve seat and to move the poppet valve member away from the valve seat to place the valve mechanism in a position where at least a portion of the poppet valve does not contact the valve seat. In a preferred embodiment, the poppet valve is fully disconnected from the valve seat when in the resting position. An actuator is connected to the valve stem and causes the valve stem to slide axially along its longitudinal axis. A pinion gear is connected to the actuator and is in meshed engagement with a second gear that is mounted to the valve shaft. A default position arrangement is operably configured with the valve stem for placing the poppet valve in a resting position where at least a portion of the poppet valve does not contact the seat when the actuator is idle from its normal operation.

The default position arrangement takes several different forms. For example, the default position arrangement is a light load return spring that acts on the valve stem to hold the poppet valve at the resting position away from the valve seat when the actuator is energized and then suddenly becomes de-energized. The default position arrangement is also a reverse full open spring that acts on the valve stem by applying torque to the spur gear in order to place the poppet valve in the resting position when the actuator is de-energized. In an alternate embodiment, the default position arrangement is also configured so that a small amount of electrical current is applied to the actuator in order to hold the poppet valve in the resting position when the actuator is shut down from its normal operation. Lastly, the default position arrangement includes a drive pin and ramp assembly having a holding feature so that when the actuator opens the poppet valve to a maximum position and becomes de-energized the holding feature holds the poppet valve open until the actuator applies torque to drive the poppet valve which moves the poppet valve to the closed position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
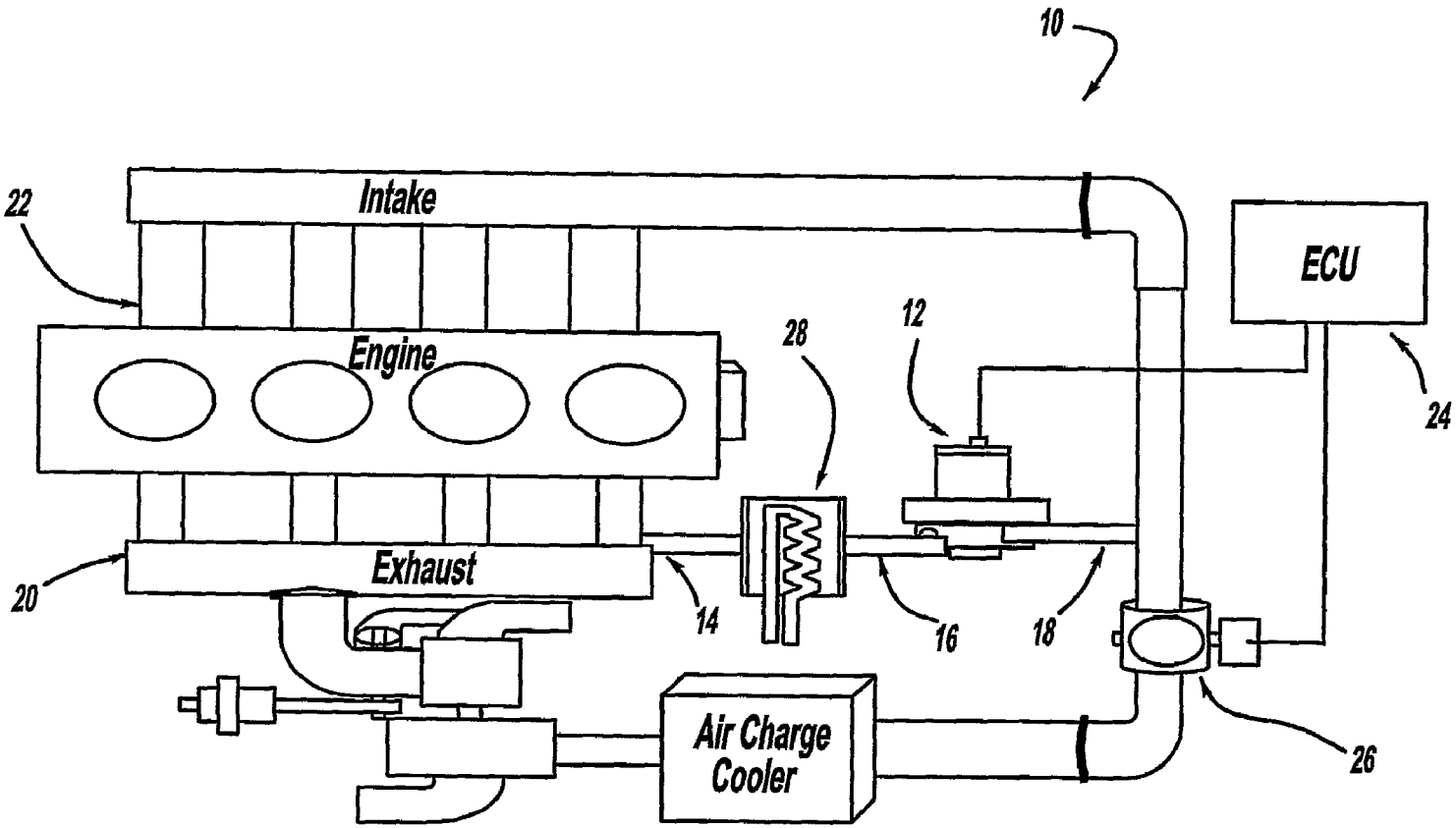
FIG - 1 Prior Art
FIG. 1 is a schematic diagram of a combustion engine system having an EGR valve incorporated thereon.
Figure 2:
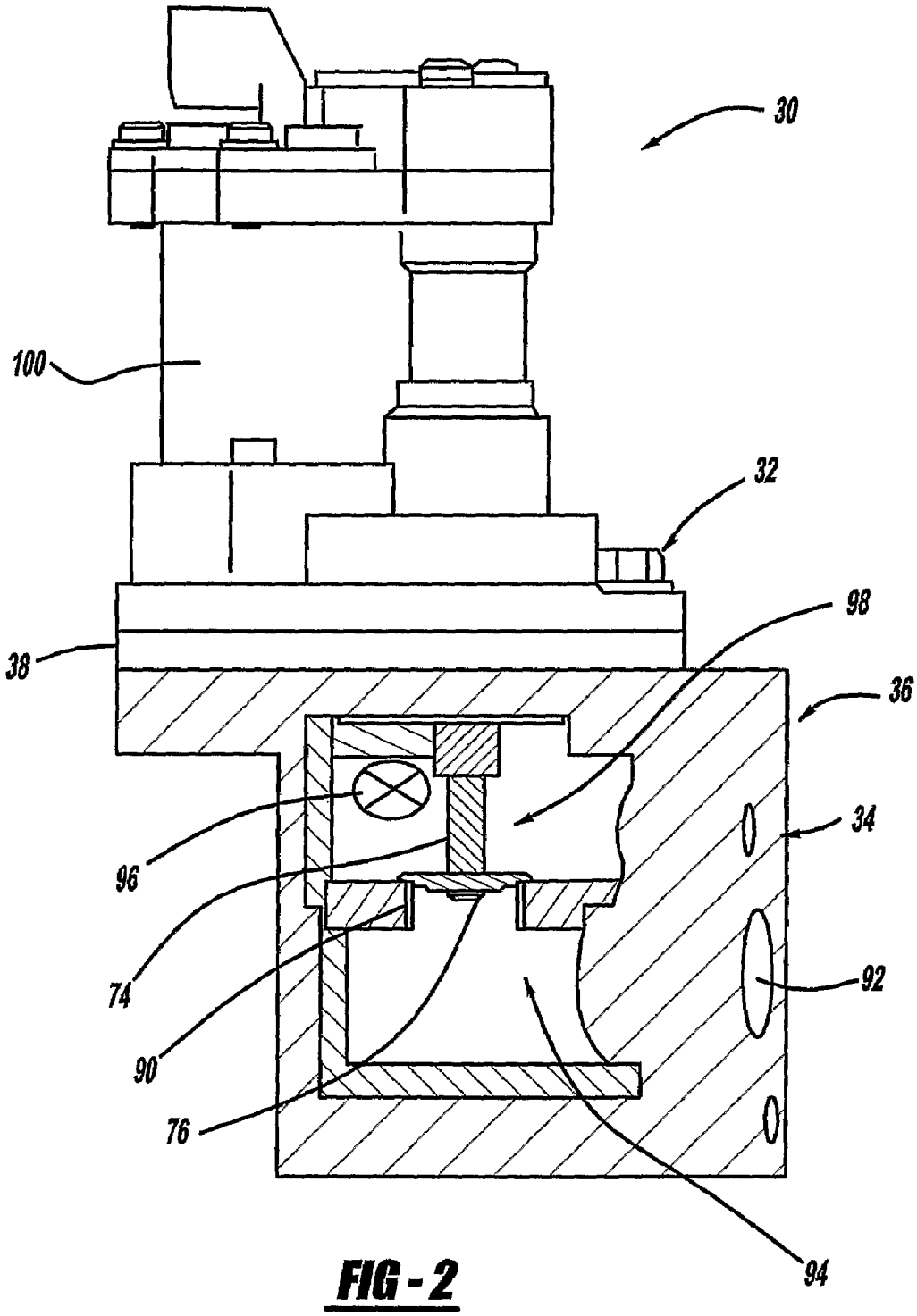
FIG. 2 is a partial cross-section perspective side view of an EGR valve body having an actuator connected thereon.

Referring to FIG. 2, an exhaust gas recirculation (EGR) valve assembly is generally shown at 30. The actuator 100 is connected to a valve body assembly 36 through the use of fasteners 32; a gasket 38 is used to prevent leakage from occurring between the actuator 100 and the valve body assembly 36. Fasteners 32 are used to locate the actuator 100 and the valve body assembly 36. The EGR valve 30 is typically mounted to the engine's intake manifold by mounting bolts. The exhaust gas flows from inlet 92, into chamber 94, through valve seat 90, by poppet valve 76, into cavity 98, and to outlet 96 when poppet valve 76 is unseated from valve seat 90 and there is a sufficient pressure differential between the inlet 92 and outlet 96. In a preferred embodiment, the pressure in chamber 94 is positive. However, in an alternate embodiment, the pressure in chamber 94 is negative or fluctuates between a positive and negative pressure.

Figure 3A:
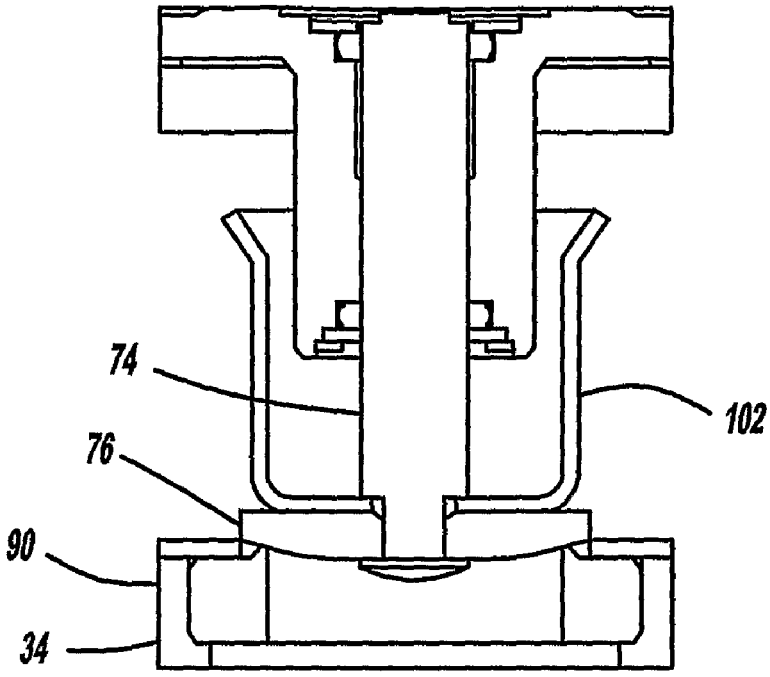
FIG. 3*a* is a cross-sectional side view of a sub-assembly with the stem, shield, and poppet valve members in a closed position.
Figure 3B:
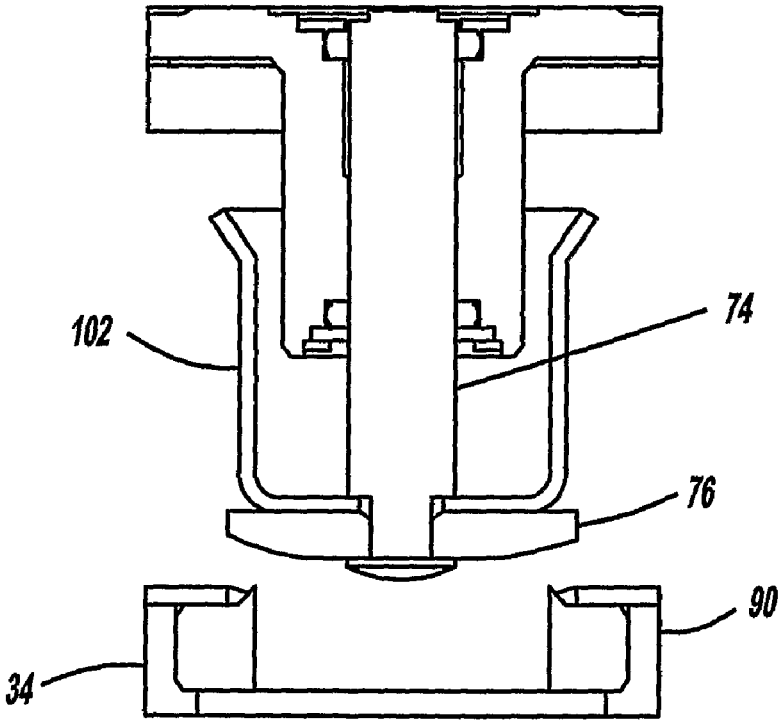
FIG. 3*b* is a cross-sectional side view of the sub-assembly with the stem, shield, and poppet valve members in an open position.

FIGS. 3*a* and 3*b* show the open and closed positions of the poppet valve 76. More specifically, FIG. 3*a* shows the closed position of the poppet valve 76, and FIG. 3*b* shows the open position of the poppet valve 76. FIGS. 3*a* and 3*b* also show a deflector 102 connected to poppet valve 76, which is used for deflecting away debris from the valve stem 74.

Figure 4:
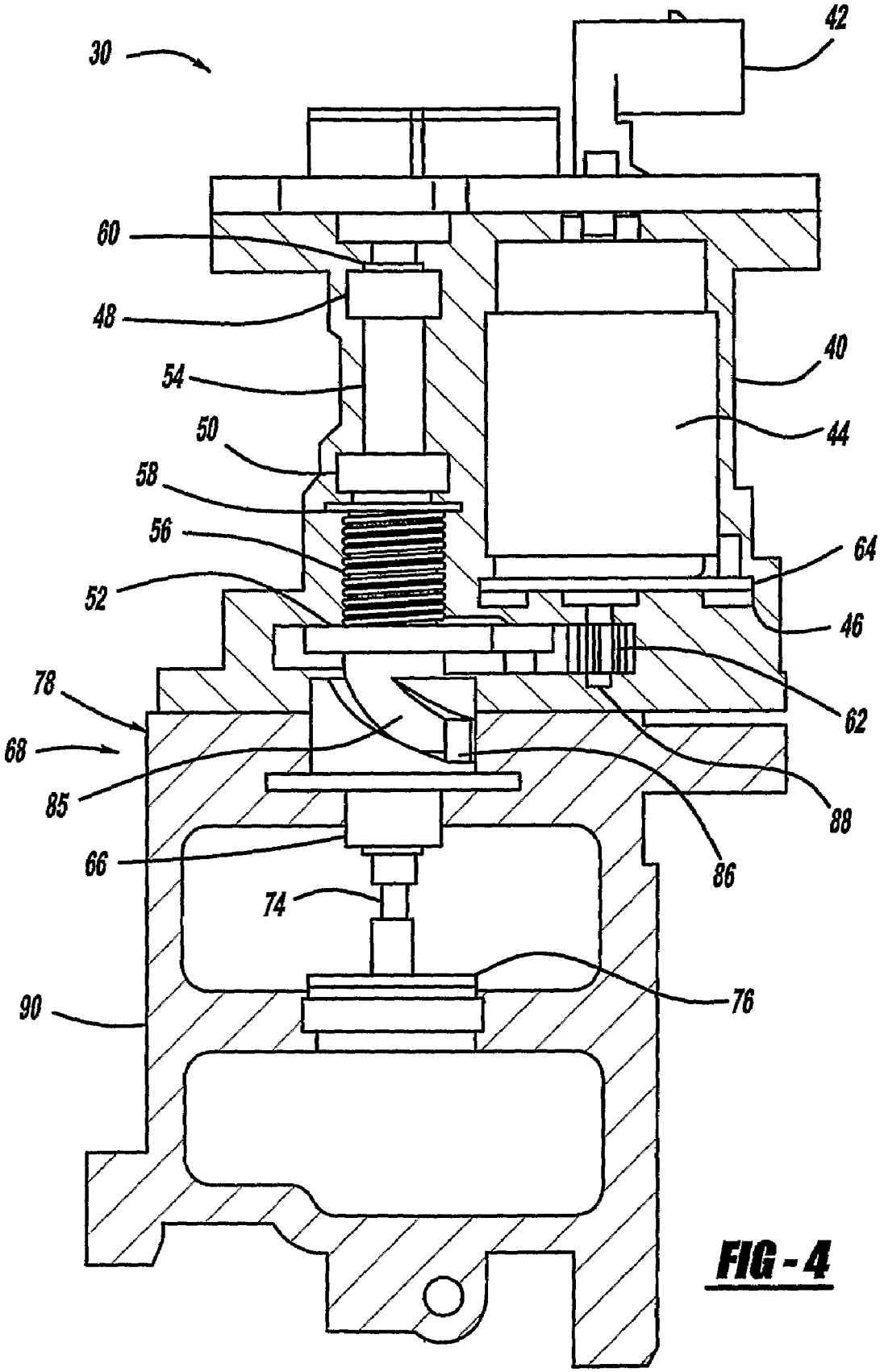
FIG. 4 is a cross-sectional perspective view of an EGR valve body with an actuator having a torsion spring acting thereon.
Figure 5:
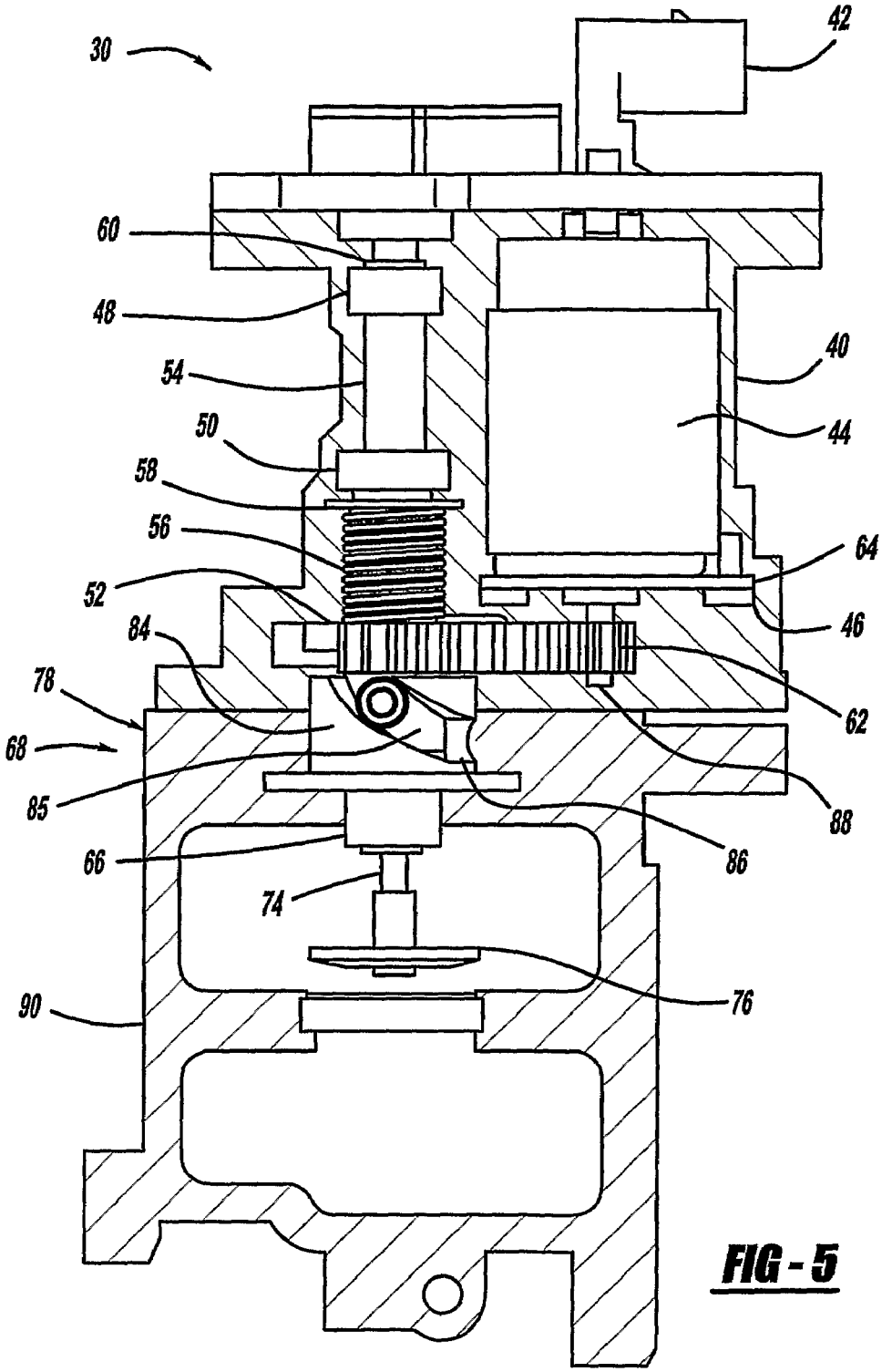
FIG. 5 is a cross-sectional perspective view of an EGR valve having a reverse torsion spring.
Figure 6:
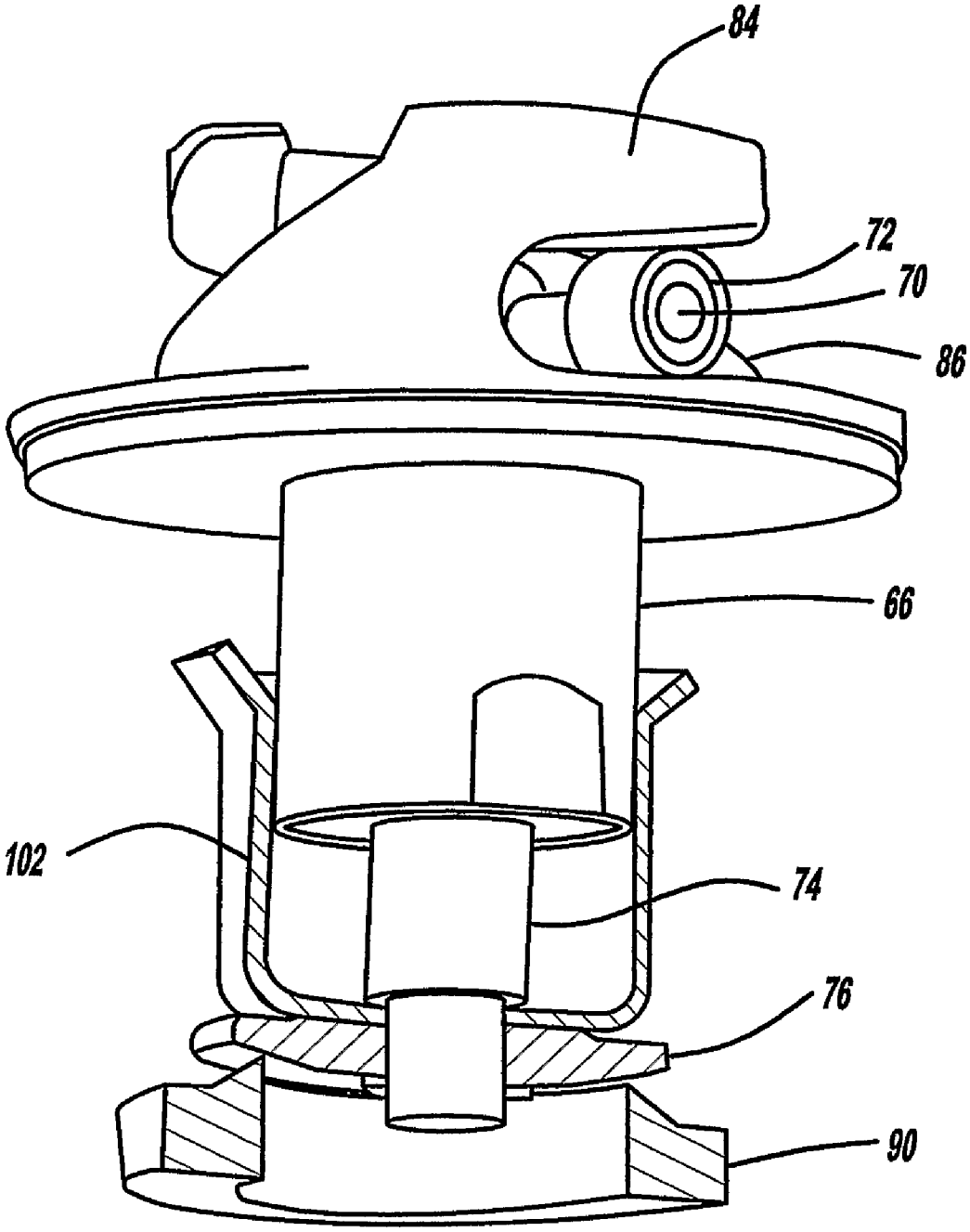
FIG. 6 is a partial cross-section view of the valve seat with the sub-assembly.

Referring to FIGS. 4, 5, and 6, EGR valve assembly 30 has a housing 40 designed to accept an electrical connector 42. In a preferred embodiment, a motor 44, and an integral bracket 64 are secured by screws 46 to the housing 40. The motor 44 is electrically connected to the electrical connector 42, such that the motor 44 draws electrical current when in use.

A bushing 48 and roller bearing 50 are fit into housing 40. A gear 52 is fastened to shaft 54. A torsion spring 56 and spring bushing 58 are placed over the shaft 54. The shaft 54 extends through the bearing 50 and bushing 58 and is retained by a clip 60. A gear 62, fastened to a motor shaft 88, engages gear 52. Thus, gear 52 rotates with respect to gear 62. The torsion spring 56 engages features on the housing 40 and gear 52 to provide torsional force that acts upon shaft 54.

A valve subassembly 68 consists of retainer housing 78, bearing guide 66, valve stem 74, pin 70, bearings 72, and poppet valve 76. Bearing 72 is fastened at one end of pin 70. The pin 70 is placed through an engagement hole at one end of valve stem 74. A second bearing is fastened to the opposite end of the pin (not shown). The valve stem 74 is installed by inserting it through the integral bearing section of bearing guide 66. The valve stem 74 is inserted until the bearing 72 contacts integral slotted guide ramp portion 84 of the bearing guide 66. The slotted guide ramp portion 84 has ramp surfaces 86 that contain and guide the bearing 72 when torque is applied to the pin 70 which forces the valve stem 74 to rotate about its longitudinal axis. The valve stem 74 moves in an axial direction as the bearing 72 moves along the slotted guide ramp portion 84. The slotted guide ramp portion surfaces 86 has a defined slope that causes the desired axial movement of the valve stem 74. The slotted guide ramp portion 84 is shown in more detail in FIGS. 4, 6, and 8. In a preferred embodiment, the slotted guide ramp portion 84 is machined into a one-piece bearing guide 66, as shown in FIG. 4. In an alternate embodiment, the slotted guide ramp portion 84 is made in more than one-piece to accommodate various assembly methods. For example, the slotted guide ramp portion 84 has an upper and lower section, each having a portion of either slotted guide ramp.

In a preferred embodiment, a poppet valve 76 is installed and retained on valve stem 74 by suitable means, such as, but not limited to, swaging. In an alternative embodiment, the poppet valve 76 is keyed to the shaft in a manner that will cause the poppet valve 76 to rotate with the shaft.

Also in a preferred embodiment, the bearing guide 66 of valve sub-assembly 68 is secured in the retainer body 78 by suitable means, such as, but not limited to, swaging as shown in FIG. 4. The actuator 100 and valve sub-assembly 68 are aligned by suitable locating features and are held together by fasteners (not shown). Gear 52 also has an integral fork feature 85 that engages pin 70. When the engine control unit provides a suitable control signal to the motor 44, it causes gears 62 and 52 to rotate. The integral fork feature 85 causes pin 70 to move bearing 72 along ramp 86 resulting in rotary-axial movement of the valve stem 74 and poppet valve 76. The control signal causes the motor 44 and gears 62 and 52 to rotate in either a clockwise or counter-clockwise direction, therefore, the valve stem 74 and poppet valve 76 are capable of moving in either direction.

Also, the EGR valve assembly 30 has a default position arrangement, which has several embodiments described below. The default position arrangement places the poppet valve 76 in any predetermined position besides the closed position. Preferably, when the poppet valve 76 is in the resting position the poppet valve 76 does not contact the valve seat 90. However, the resting position can be a position where the poppet valve 76 is only partially contacting the valve seat 90 when compared to the contact between the poppet valve 76 and valve seat 90 when the poppet valve 76 is in the closed position.

The first embodiment of the present invention is comprised of a low-torque torsion spring 56, which is placed over a shaft along with the spring bushing 58. In this embodiment, the torsion spring 56 engages the housing and the gear 52 in order to provide torsion force against the shaft 54. Thus, the torsion spring 56 is configured so that after the poppet valve 76 is opened to its fully open position, and power to the motor 44 is cut off, the torsion exerted by the torsion spring 56 is not forceful enough to overcome the system friction required to bring the poppet valve 76 back into contact with the valve seat 90 or prevents the poppet valve 76 from fully contacting the valve seat 90. The poppet valve 76 being prevented from being placed in the closed position while the EGR valve assembly 30 is not in operation prevents the poppet valve 76 from sticking to valve seat 90 as the system cools, and any debris build-up in the system cools as well.

A second embodiment of the present invention comprises having the torsion spring 56 configured to bias the poppet valve 76 toward the open position. This is achieved by using a torsion spring 56 that has a winding direction opposite that of a spring that biases poppet valve 76 in the closed position. When power to the motor 44 is cut off, and no load besides the load from the torsion spring 56 is being applied to poppet valve 76, poppet valve 76 is held in an open position, until power is supplied to the motor 44. When the motor 44 is actuated, the bias force of the torsion spring 56 is overcome and the poppet valve 76 closes. This embodiment can be achieved by using a slotted guide ramp portion 86 geometry that is reversed rather than a torsion spring 56 that has a winding direction that is reversed.

Figure 7:
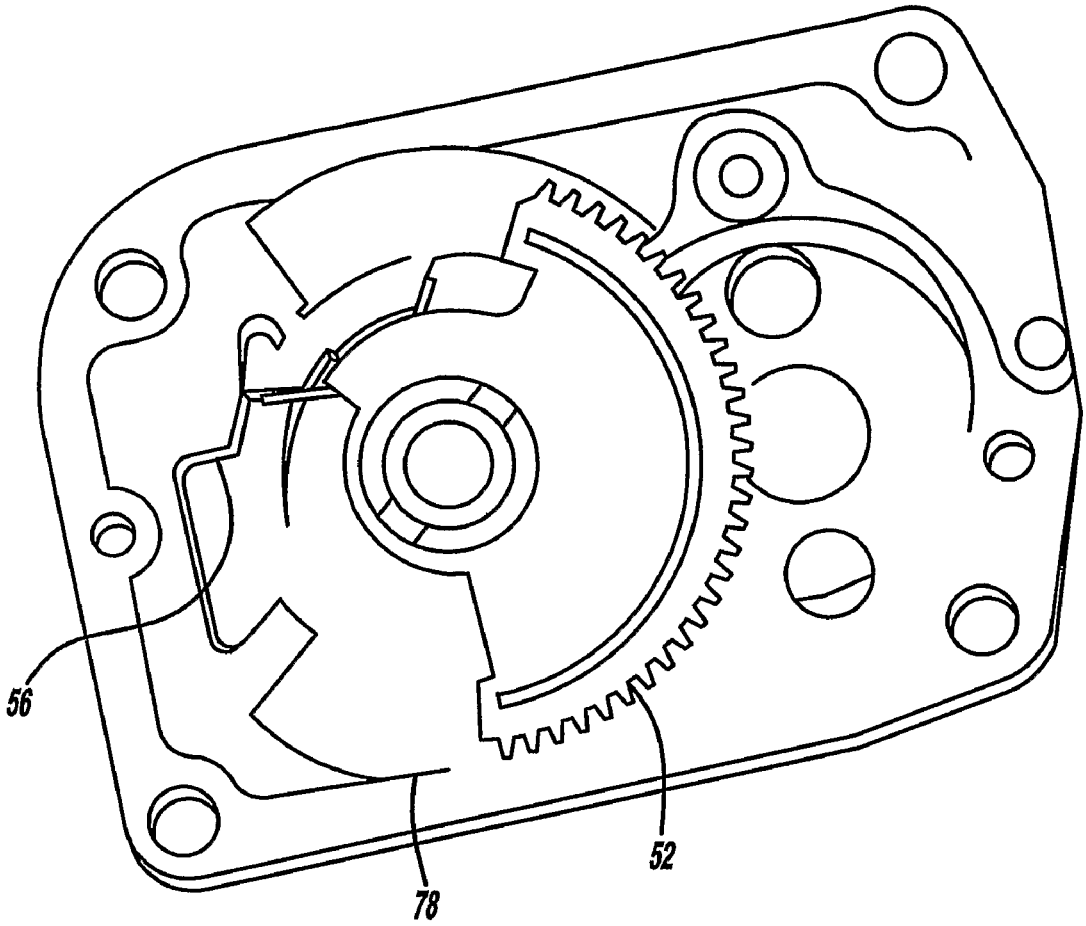
FIG. 7 is an overhead perspective view of the valve body and spur gear having a default position spring.

In a third embodiment of the present invention, the torsion spring 56 is configured to provide a default position for the poppet valve 76. This default, or intermediate, position of gear 52 is shown in FIG. 7. The torsion spring 56 geometry and the actuator housing 40 geometry are designed such that when the motor 44 is un-powered, the poppet valve 76 is located in a default or intermediate position that is a specified distance off of the valve seat 90. This is accomplished by using a torsion spring 56 that has a sufficient amount of force to move the poppet valve 76 to the default position.

In a fourth embodiment of the present invention, the poppet valve 76 is electronically placed in the open position or in a position where at least part of the poppet valve 76 is not contacting the valve seat 90. In this embodiment, a small amount of electrical current is used to power the poppet valve 76 to an unseated position when the engine is shut down. The small amount of electrical current flows through the actuator 100 keeping the poppet valve 76 in the open position or prevents it from fully contacting the valve seat 90 for a predetermined period of time. Typically, the predetermined amount of time is a time period that is long enough for the contamination to cure or harden; thereby, preventing the "bonding" of the poppet valve 76 to the valve seat 90. No geometry or hardware changes are required for this method, but the Engine Control Module (ECM) has to be altered to provide electrical power in a shutdown mode without draining the vehicle battery.

Figure 8:
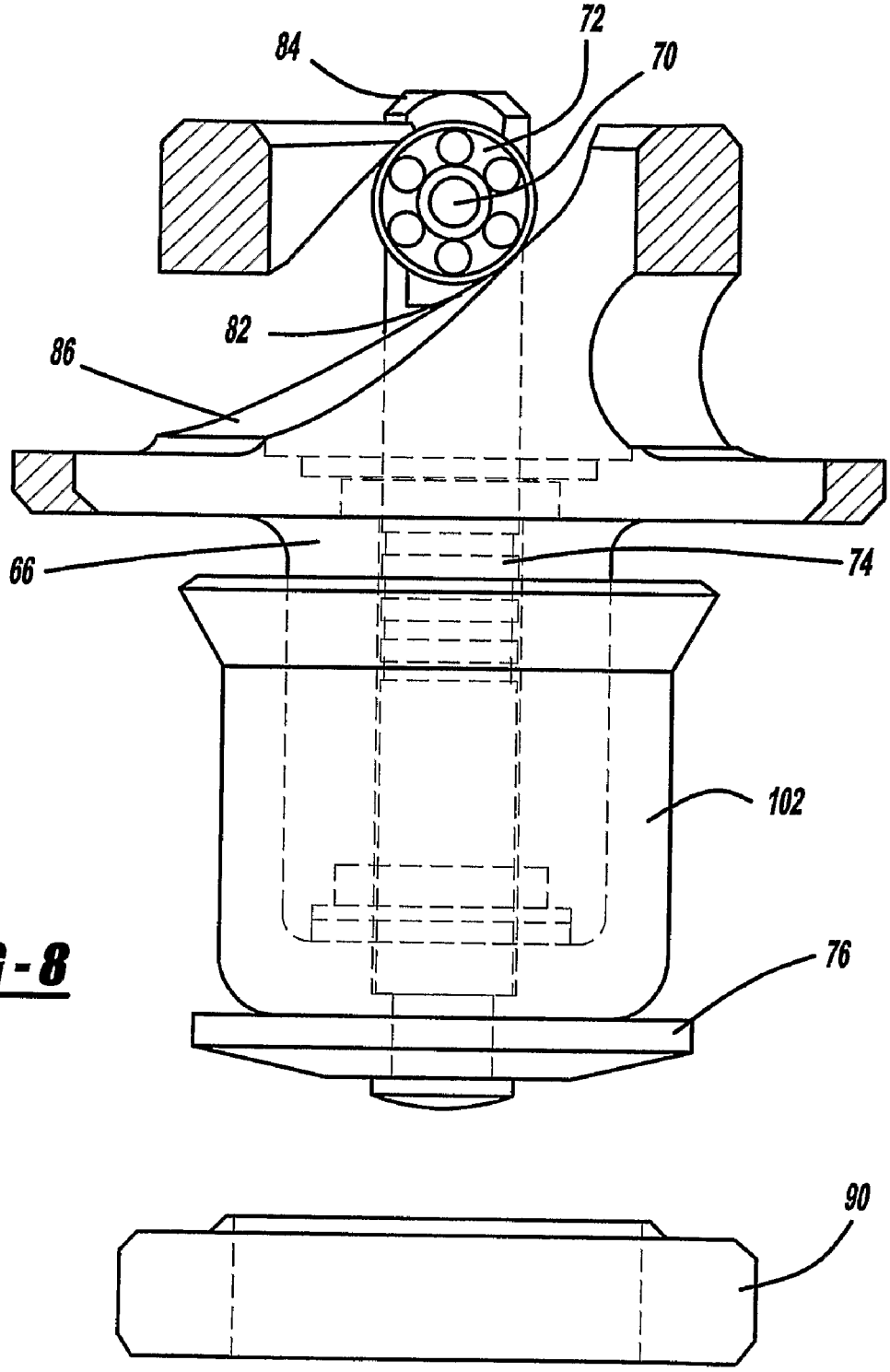
FIG. 8 is a perspective view of the EGR valve seat having a wedge ramp feature.

The fifth embodiment of the present invention is shown in FIG. 8. In this embodiment, a holding feature 82 is added to the bearing slotted guide ramp portion 84 or cam mechanism such that the poppet valve 76 is electrically powered past the maximum allowable flow position before engine shutdown. Therefore, the poppet valve 76 remains above the holding feature 82 in a full stroke unseated position until the motor 44 direction is reversed and electrical current is applied to power the drive bearing 72 back over the holding feature 82 onto the active part of the ramps 86. Examples of the holding feature 86 are, but not limited to, a wedge, an even surface, a bump, or a detent area, where the bearing 72 contacts the holding feature 86 when moving along the slotted guide ramp member 86. Thus, a force is applied to the bearing 72 in order for bearing 72 to pass back over the holding feature 86, where the poppet valve 76 moves towards the closed position.

All five of the aforementioned embodiments keep the poppet valve 76 and valve seat 90 out of contact with each other or partially out of contact with each other while the debris is curing or hardening which would ultimately cause the poppet valve 76 to bond to the valve seat 90 making the EGR valve assembly 30 inoperable. In a preferred embodiment, the embodiments do not allow the poppet valve 76 from contacting the valve seat 90 during the curing process to ensure there is no bonding between the two parts. Alternatively, the above embodiments, allow the poppet valve 76 to partially contact the valve seat 90, which reduces the amount of surface area of the poppet valve 76 and the valve seat 90 that bond together. Thus, the bonding that does occur is overcome by the torque applied to the poppet valve 76, which is a lesser torque than needed to separate the poppet valve 76 from the valve seat 90 when the poppet valve 76 is in the closed position during the curing process.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A mechanism for preventing sticking in an exhaust gas recirculation valve assembly for use in a motor vehicle, comprising:

a valve body having an inlet port and an outlet port;

a valve seat disposed in said valve body, wherein said valve seat has an aperture positioned in the path of fluid flow between said inlet port and said outlet port;

a valve stem in said valve body, wherein said valve stem moves within said valve body;

a poppet valve connected to said valve stem, wherein said poppet valve is configured to contact said valve seat when said poppet valve is in a closed position;

an actuator connected to said valve stem, wherein said actuator alters the position of said poppet valve; and a default position arrangement for placing said poppet valve in a resting position, wherein at least a portion of said poppet valve is positioned away from said valve seat when said actuator is idle, said default position arrangement including at least one spring that is a reverse full open spring operably connected to said poppet valve, said reverse full open spring is wound in the opposite direction of a torsion spring that forces said poppet valve to said closed position, such that when said actuator is idle, said spring opens said poppet valve to said resting position.

2. The mechanism for preventing sticking in an exhaust gas recirculation valve assembly of claim 1, wherein when said default position arrangement places said poppet valve in said resting position, said poppet valve is fully separated from said valve seat.

3. A mechanism for preventing sticking in an exhaust gas recirculation valve assembly for use in a motor vehicle, comprising:

a valve body having an inlet port and an outlet port;

a valve seat disposed in said valve body, wherein said valve seat has an aperture positioned in the path of fluid flow between said inlet port and said outlet port;

a valve stem in said valve body, wherein said valve stem moves within said valve body;

a poppet valve connected to said valve stem, wherein said poppet valve is configured to contact said valve seat when said poppet valve is in a closed position;

an actuator connected to said valve stem, wherein said actuator alters the position of said poppet valve;

a default position arrangement for placing said poppet valve in a resting position, wherein at least a portion of said poppet valve is positioned away from said valve seat when said actuator is idle, said default position arrangement including at least one spring operably connected to said poppet valve, wherein said at least one spring is a torsion spring operably connected to said poppet valve and said torsion spring places said poppet valve in said resting position when said actuator is idle, such that said torsion spring applies a force against said poppet valve so that said poppet valve is directed away from said closed position and said poppet valve is placed in said resting position.

4. A mechanism for preventing sticking in an exhaust gas recirculation valve assembly for use in a motor vehicle, comprising:

a valve body having an inlet port and an outlet port;

a valve seat disposed in said valve body, wherein said valve seat has an aperture positioned in the path of fluid flow between said inlet port and said outlet port;

a valve stem in said valve body, wherein said valve stem moves within said valve body;

a poppet valve connected to said valve stem, wherein said poppet valve is configured to contact said valve seat when said poppet valve is in a closed position;

an actuator connected to said valve stem, wherein said actuator alters the position of said poppet valve;

a default position arrangement for placing said poppet valve in a resting position, wherein at least a portion of said poppet valve is positioned away from said valve seat when said actuator is idle;

a pinion gear connected to said actuator;

a spur gear mounted on said valve shaft in mesh with said pinion gear; and a drive pin and ramp assembly coupling said spur gear to said valve stem, wherein said poppet valve changes positions when said spur gear rotates.

5. The mechanism for preventing sticking in an exhaust gas recirculation valve assembly of claim 4, wherein said default position arrangement comprises said drive pin and a ramp assembly having a holding feature, such that when said actuator opens said poppet valve to its maximum position and is idle from normal operating conditions, said holding feature holds said poppet valve in said resting position until said actuator applies torque to drive said poppet valve to said closed position.

6. A mechanism for preventing sticking in an exhaust gas recirculation valve assembly for use in a motor vehicle, comprising:

a valve body having an inlet port and an outlet port;

a valve seat disposed in said valve body, wherein said valve seat has an aperture positioned in the path of fluid flow between said inlet port and said outlet port;

a valve stem in said valve body, wherein said valve stem moves within said valve body;

a poppet valve connected to said valve stem, wherein said poppet valve is configured to contact said valve seat when said poppet valve is in a closed position;

an actuator connected to said valve stem, wherein said actuator alters the position of said poppet valve; and a default position arrangement including an electrical current to said actuator to hold said poppet valve in said resting position when said actuator is idle.

7. The mechanism for preventing sticking in an exhaust gas recirculation valve assembly of claim 6, wherein said electrical current drawn by said actuator is a small electrical current in order to prevent said actuator from draining a battery from a vehicle electrical system.

8. A mechanism for preventing sticking in an exhaust gas recirculation valve assembly for use in a motor vehicle, comprising:

a valve body having an inlet port and an outlet port;

a valve seat disposed in said valve body, wherein said valve seat has an aperture positioned in the path of fluid flow between said inlet port and said outlet port;

a valve stem in said valve body, wherein said valve stem moves within said valve body;

a poppet valve connected to said valve stem, wherein said poppet valve is configured to contact said valve seat when said poppet valve is in a closed position;

an actuator operably connected to said valve stem, wherein said actuator alters the position of said poppet valve;

a pinion gear connected to said actuator;

a spur gear mounted on said valve shaft in mesh with said pinion gear;

a drive pin and ramp assembly coupling said spur gear to said valve stem, wherein said poppet valve changes positions when said spur gear rotates; and at least one spring for placing said poppet valve in a resting position, wherein said at least one spring acts on said poppet valve so that at least a portion of said poppet valve is positioned away from said valve seat when said actuator is idle.

9. The mechanism for preventing sticking in an exhaust gas recirculation valve assembly of claim 8, wherein said spring is a light load return spring acting on said valve stem, wherein said light load return spring applies a lesser force than frictional forces in said exhaust gas recirculation valve assembly, thereby holding said poppet valve open in said resting position.

10. The mechanism for preventing sticking in an exhaust gas recirculation valve assembly of claim 8, wherein said spring is a reverse full open spring that is wound in the opposite direction of a torsion spring that forces said poppet valve to said closed position, such that when said actuator is idle, said spring opens said poppet valve to said resting position.

11. The mechanism for preventing sticking in an exhaust gas recirculation valve assembly of claim 8, wherein said spring is a torsion spring is operably connected to said poppet valve and said torsion spring places said poppet valve in said resting position when said actuator is idle from normal operating conditions, such that said torsion spring applies a force against said poppet valve so that said poppet valve is directed away from said closed position and said poppet valve is placed in said resting position.

12. The mechanism for preventing sticking in an exhaust gas recirculation valve assembly of claim 8, wherein when said at least one spring places said poppet valve in said resting position, said poppet valve is fully separated from said valve seat.

13. A mechanism for preventing sticking in an exhaust gas recirculation valve assembly for use in a motor vehicle, comprising:

a valve body having an inlet port and an outlet port;

a valve seat disposed in said valve body, wherein said valve seat has an aperture positioned in the path of fluid flow between said inlet port and said outlet port;

a valve stem in said valve body, wherein said valve stem moves within said valve body;

a poppet valve connected to said valve stem, wherein said poppet valve is configured to contact said valve seat when said poppet valve is in a closed position;

an actuator connected to said valve stem, wherein said actuator alters the position of said poppet valve;

a pinion gear connected to said actuator;

a spur gear mounted on said valve shaft in mesh with said pinion gear;

a drive pin and ramp assembly coupling said spur gear to said valve stem, wherein said poppet valve changes positions when said spur gear rotates; and a holding feature in said drive pin and a ramp assembly so that when said actuator opens said poppet valve to its maximum position and is idle, said holding feature holds said poppet in a resting position until said actuator applies torque to drive said poppet valve to said closed position, wherein when said poppet valve is in said resting position at least a portion of said poppet valve is positioned away from said valve seat when said actuator is idle.

14. The mechanism for preventing sticking in an exhaust gas recirculation valve assembly of claim 13, wherein when said poppet valve is in said resting position, said poppet valve is fully separated from said valve seat.

15. A mechanism for preventing sticking in an exhaust gas recirculation valve assembly for use in a motor vehicle, comprising:

a valve body having an inlet port and an outlet port;

a valve seat disposed in said valve body, wherein said valve seat has an aperture positioned in the path of fluid flow between said inlet port and said outlet port;

a valve stem in said valve body, wherein said valve stem moves within said valve body;

a poppet valve connected to said valve stem, wherein said poppet valve is configured to contact said valve seat when said poppet valve is in a closed position;

an actuator connected to said valve stem, wherein said actuator alters the position of said poppet valve;

a pinion gear connected to said actuator;

a spur gear mounted on said valve shaft in mesh with said pinion gear;

a drive pin and ramp assembly coupling said spur gear to said valve stem, wherein said poppet valve changes positions when said spur gear rotates; and an electrical current drawn by said actuator so that said actuator holds said poppet valve in a resting position when said actuator is idle, wherein said resting position is where at least a portion of said poppet valve is positioned away from said valve seat when said actuator is idle.

16. The mechanism for preventing sticking in an exhaust gas recirculation valve assembly of claim 15, wherein said electrical current drawn by said actuator is a small electrical current in order to prevent said actuator from draining a battery from a vehicle electrical system.

17. The mechanism for preventing sticking in an exhaust gas recirculation valve assembly of claim 15, wherein when said default position arrangement places said poppet valve in said resting position, said poppet valve is fully separated from said valve seat.

* * * * *